US009136613B2

(12) United States Patent
Matsushita

(10) Patent No.: US 9,136,613 B2
(45) Date of Patent: Sep. 15, 2015

(54) ELECTRIC CONNECTION TERMINAL

(71) Applicant: YAZAKI CORPORATION, Minato-ku, Tokyo (JP)

(72) Inventor: Kouichiro Matsushita, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/132,030

(22) Filed: Dec. 18, 2013

(65) Prior Publication Data

US 2014/0106629 A1 Apr. 17, 2014

Related U.S. Application Data

(63) Continuation of application No. PCT/JP2012/003986, filed on Jun. 19, 2012.

(30) Foreign Application Priority Data

Jun. 20, 2011 (JP) ..... 2011-136542

(51) Int. Cl.
*H01R 4/18* (2006.01)
*H01R 4/20* (2006.01)
*H01R 13/52* (2006.01)

(52) U.S. Cl.
CPC ..... *H01R 4/206* (2013.01); *H01R 4/185* (2013.01); *H01R 13/52* (2013.01); *H01R 13/5216* (2013.01)

(58) Field of Classification Search
CPC .. H01R 9/0524; H01R 13/58; H01R 13/5808; H01R 4/18
USPC ..... 439/877–882
See application file for complete search history.

(56) References Cited

U.S. PATENT DOCUMENTS 3,594,713 A 7/1971 Thoman
3,728,665 A 4/1973 Frey
3,955,044 A * 5/1976 Hoffman et al. ..... 174/84 C (Continued)

FOREIGN PATENT DOCUMENTS

CN 101262091 A 9/2008
CN 101861680 A 10/2010

(Continued)

OTHER PUBLICATIONS

The Chinese office action letter issued on May 6, 2015 in the counterpart Chinese patent application.

(Continued)

*Primary Examiner* — Truc Nguyen
(74) *Attorney, Agent, or Firm* — Marvin A. Motsenbocker; Mots Law, PLLC

(57) ABSTRACT

An electric connection terminal includes a contact section for electrical connection to an opposite terminal and a crimping section with the contact section being crimped to cover the conductor and cover of a covered electric wire. The crimping section includes a conductor crimping part to be tightly attached to and crimped around the conductor, a cover crimping part to be tightly attached to and crimped around the cover of the covered electric wire, and a boundary crimping part to be tightly attached to and crimped around the vicinity of a boundary between the cover and conductor. A compression ratio of the boundary crimping part in a state of crimped around the covered electric wire is set to be higher than that of the cover crimping part.

4 Claims, 2 Drawing Sheets

(56) References Cited

U.S. PATENT DOCUMENTS

| | | | | |
|---|---|---|---|---|
| 4,118,097 | A * | 10/1978 | Budnick | 439/387 |
| 5,254,022 | A * | 10/1993 | Stuart | 439/877 |
| 6,206,727 | B1 * | 3/2001 | Aoyama et al. | 439/585 |
| 8,221,171 | B2 * | 7/2012 | Ono et al. | 439/877 |
| 8,519,267 | B2 * | 8/2013 | Peters et al. | 174/77 R |
| 2013/0130569 | A1 * | 5/2013 | Sato | 439/882 |
| 2014/0235117 | A1 * | 8/2014 | Sato | 439/877 |

FOREIGN PATENT DOCUMENTS

| | | | |
|---|---|---|---|
| DE | 19843886 | A1 | 3/2000 |
| DE | 10223397 | A1 | 12/2003 |
| JP | S5330189 | U | 3/1978 |
| JP | 2010-015915 | A | 1/2010 |
| JP | 2010-205583 | A | 9/2010 |

OTHER PUBLICATIONS

The Japanese office action letter issued on Jun. 2, 2015 in the counterpart Japanese patent application.

The Korean office action letter issued on Feb. 16, 2015 in the counterpart Korean application. The Japanese office action letter issued on Apr. 7, 2015 in the counterpart Japanese application.

* cited by examiner

ELECTRIC CONNECTION TERMINAL

CROSS REFERENCE TO RELATED APPLICATION

This application is a Continuation of PCT Application No. PCT/JP2012/003986, filed on Jun. 19,2012, and claims the benefit of priority under 35 U.S.C. 119(a) to Japanese Patent Application No. 2011-136542 filed on Jun. 20, 2011, the entire contents of which are incorporated by reference herein.

TECHNICAL FIELD

The present invention relates to an electric connection terminal connected to a covered electric wire.

BACKGROUND ART

A known electric connection terminal usually has a contact section to be electrically connected to an opposite terminal and a wire crimping section that is a swaging section integral with the contact section and is crimped around the conductor and cover of a covered electric wire so as to be electrically connected and fixed to the covered electric wire. One is described in, for example, Japanese Unexamined Patent Application Publication No. 2010-15915.

This electric connection terminal includes a wire barrel to crimp the wire crimping section around the conductor of the covered electric wire, an insulation barrel to crimp the cover of the covered electric wire, and a continuous wall to connect the wire barrel and insulation barrel to each other.

When the wire crimping section is crimped at an end of the covered electric wire, the continuous wall prevents the conductor of the covered electric wire from being exposed to the outside between the wire barrel and the insulation barrel, thereby suppressing electrolytic corrosion of the conductor.

SUMMARY OF INVENTION

Technical Problem

The above-mentioned electric connection terminal, however, forms a gap between the crimping section and the covered electric wire at a position of the continuous wall when the crimping section is crimped around the covered electric wire. The gap may allow water and the like to enter.

The present invention provides an electric connection terminal capable of preventing the formation of a gap between a crimping section and a covered electric wire and improving water resistance.

Solution to Problem

According to a technical aspect of the present invention, there is provided an electric connection terminal including a contact section to be electrically connected to an opposite terminal and a crimping section that is integral with the contact section and is crimped to cover the conductor and cover of a covered electric wire so as to be electrically connected and fixed to the covered electric wire. The crimping section includes a conductor crimping part to be tightly attached to and crimped around the conductor of the covered electric wire, a cover crimping part to be tightly attached to and crimped around the cover of the covered electric wire, and a boundary crimping part to be tightly attached to and crimped around the vicinity of a boundary between the cover and conductor of the covered electric wire. The boundary-crimping portion is designed with a higher compressibility in a state in which the coated electrical cable has been crimped than the compressibility of the coating-crimping portion.

It is a perspective view of an electric connection terminal according to an embodiment of the present invention.

[FIG. 2]

Figure 1:
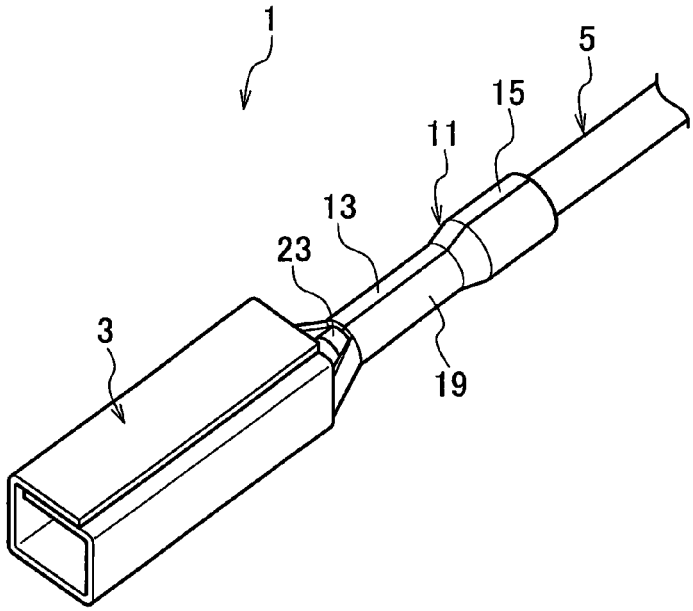
[FIG. 1]

It is a fragmentary sectional view, taken from FIG. 1, of the electric connection terminal according to the embodiment of the present invention.

[FIG. 3]

(a) is a sectional view of a conductor crimping part of the electric connection terminal according to the embodiment of the present invention. (b) is a sectional view of a boundary crimping part of the electric connection terminal according to the embodiment of the present invention, and (c) is a sectional view of a cover crimping part of the electric connection terminal according to the embodiment of the present invention.

DESCRIPTION OF EMBODIMENTS

Figure 2:
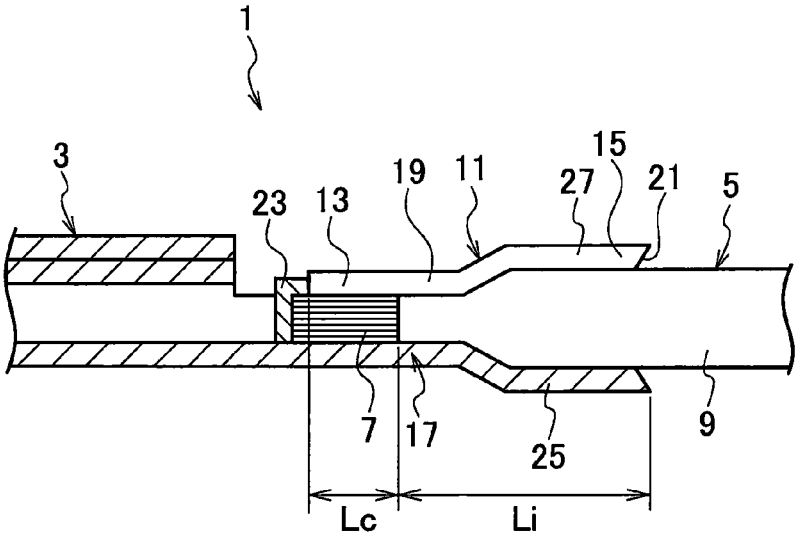
Figure 3:
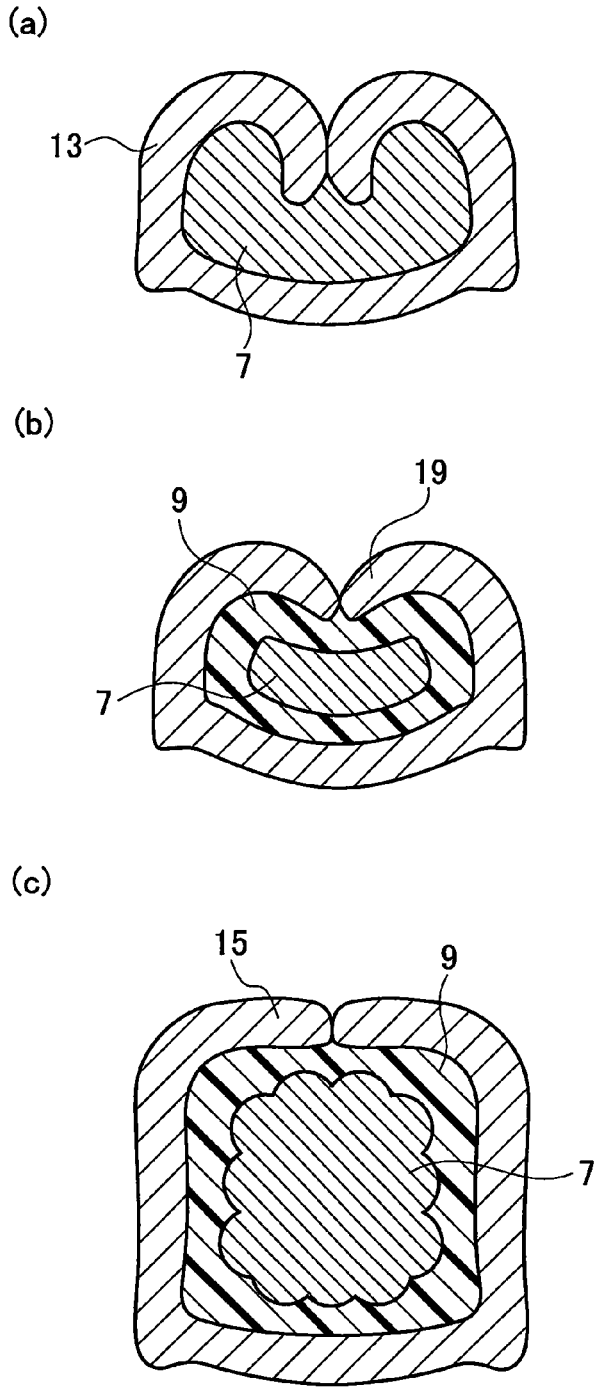

With reference to FIGS. 1 to 3, an electric connection terminal according to an embodiment of the present invention will be explained.

The electric connection terminal 1 according to the embodiment includes a contact section 3 to be electrically connected to an opposite terminal (not illustrated) and a crimping section 11 that is integrally formed with the contact section 3 and is crimped to cover a conductor 7 and cover 9 of a covered electric wire (cable) 5 so as to be electrically connected and fixed to the covered electric wire 5.

The crimping section 11 includes a conductor crimping part 13 to be tightly attached to and crimped around the conductor 7 of the covered electric wire 5, a cover crimping part 15 to be tightly attached to and crimped around the cover 9 of the covered electric wire 5, and a boundary crimping part 19 to be tightly attached to and crimped around the vicinity of a boundary 17 between the cover 9 and conductor 7 of the covered electric wire 5.

The crimping section 11 has a conductor crimping portion 13 that is tight-contact crimped to the conductor portion 7 of the coated electrical cable 5, a coating-crimping portion 15 that is tight-contact crimped to the coating 9 on the coated electrical cable 5, and a boundary-crimping portion 19 that is tight-contact crimped to the boundary 17 between the coated electrical cable 5 coating 9 and conductor portion 7, and thereabouts. The boundary-crimping portion 19 is designed with a higher compressibility in a state in which the coated electrical cable 5 has been crimped than the compressibility of the coating-crimping portion 15.

In addition, the crimping section 11 is provided with a taper 21 at an end of the cover crimping part 15, to form a downward slope toward the conductor 7.

Also, at an end of the conductor crimping part 13 of the crimping section 11, there is a sealing member 23 to seal the inside of the crimping section 11.

As illustrated in FIGS. 1 to 3, the electric connection terminal 1 has the contact section 3 and crimping section 11. The contact section 3 is a cylindrical female mold to receive a tab of the opposite terminal, i.e., a male mold terminal (not illustrated) so that the opposite terminal and electric connection terminal 1 are electrically connected to each other. The contact section 3 is integral with the crimping section 11.

The crimping section 11 has a bottom wall 25 and a pair of side walls 27. The bottom wall 25 is a member continuous to the contact section 3 and extends in a longitudinal direction of the electric connection terminal 1. The bottom wall 25 is arranged under the conductor 7 and cover 9 of the covered electric wire 5. Each widthwise side of the bottom wall 25 is provided with the side wall 27.

The pair of side walls 27 are each a member continuous to the widthwise side of the bottom wall 25. The pair of side walls 27 are crimped at an end of the covered electric wire 5 where the conductor 7 is exposed by removing the cover 9 with a jig (not illustrated) having upper and lower dies.

The pair of side walls 27 include the conductor crimping part 13 to be tightly attached to and crimped around the conductor 7 of the covered electric wire 5, the cover crimping part 15 to be tightly attached to and crimped around the cover 9 of the covered electric wire 5, and the boundary crimping part 19 to be tightly attached to and crimped around the vicinity of the boundary 17 between the cover 9 and conductor 7 of the covered electric wire 5. Accordingly, inner faces of the pair of side walls 27 are tightly attached to an entire area from the conductor 7 to the cover 9 of the covered electric wire 5.

The conductor crimping part 13 is tightly attached to the conductor 7 of the covered electric wire 5, to electrically connect the covered electric wire 5 and electric connection terminal 1 to each other. The compressibility of the conductor-crimping portion 13 with respect to the conductor 7 is designed to be higher than that of the coating-crimping portion 15 as well as the boundary-crimping portion 19. That is, the compressibility of the conductor-crimping portion 13 is designed to be the highest of the crimping section 11 portions. This suppresses water and the like from penetrating the crimping section 11 from the conductor crimping part 13 side.

The cover crimping part 15 is tightly attached to the cover 9 of the covered electric wire 5, to fix the electric connection terminal 1 to the covered electric wire 5. The compressibility of the coating-crimping portion 15 with respect to the coating 9 is designed to be lower than that of the conductor-crimping portion 13 as well as the boundary-crimping portion 19. That is, the compressibility of the coating-crimping portion 15 is designed to be the lowest of the crimping section 11 portions. It will be appreciated that the compressibility of the coating-crimping portion 15 is determined to be that extent at which the electrical connection terminal 1 is fixed to the coated electrical cable 5, and water cannot invasively enter in between the coating-crimping portion 15 and the coating 9.

The boundary crimping part 19 is tightly attached to the vicinity of the boundary 17 between the cover 9 and conductor 7 of the covered electric wire 5, to prevent the formation of a gap between the crimping section 11 and the covered electric wire 5. The compressibility of the boundary-crimping portion 19 with respect to the boundary region 17 and its environs is designed to be higher than that of the coating-crimping portion 15. As a result, the outer diameter of the cover 9 at the boundary crimping part 19 is tightened and reduced smaller than the outer diameter of the cover 9 at the cover crimping part 15, so that no gap is formed between the boundary crimping part 19 and the covered electric wire 5 and no water penetrates the location.

In such a crimping section 11, the longitudinal length Li of the part to crimp the cover 9 of the covered electric wire 5 is set to be longer than the length Lc of the conductor crimping part 13. Even if water enters from an end of the cover crimping part 15 into the crimping section 11, the water is suppressed from reaching the conductor 7 because of the long distance up to the conductor 7.

At an end of the cover crimping part 15, the taper 21 is present to form a downward slope toward the conductor 7. The taper 21 prevents the end of the cover crimping part 15 from piercing and damaging the cover 9 when the crimping section 11 is crimped around the covered electric wire 5.

In such a crimping section 11, an end of the conductor crimping part 13 is provided with the sealing member 23 to seal the inside of the crimping section 11.

The sealing member 23 is an insulating material or a conductive material. The insulating material may be synthetic rubber, ultraviolet curable resin, or the like. If the sealing member 23 is made of synthetic rubber, the rubber is formed into a cap shape. Before crimping the crimping section 11 around the covered electric wire 5, the synthetic rubber is set to a tip of the conductor 7 of the covered electric wire 5. In this state, the crimping section 11 is set on the covered electric wire 5 and the crimping section 11 is crimped with a jig so that a tip of the conductor crimping part 13 covers the synthetic rubber. The synthetic rubber serving as the sealing member 23 is closely attached to an outer circumferential face of the conductor 7 and an inner circumferential face of the conductor crimping part 13, thereby sealing the inside of the crimping section 11.

If ultraviolet curable resin is used as the sealing member 23, the crimping section 11 is crimped around the covered electric wire 5 and the ultraviolet curable resin is applied to a tip of the conductor crimping part 13 so that the resin covers the conductor 7 and seal the tip of the conductor crimping part 13. Then, ultraviolet rays are applied to harden the ultraviolet curable resin. The ultraviolet curable resin serving as the sealing member 23 prevents the conductor 7 from being exposed to the outside and is closely attached to a front end face of the conductor crimping part 13, thereby sealing the inside of the crimping section 11.

In this way, the sealing member 23 made of the insulating material enhances tight contact among the sealing member 23, conductor 7, and crimping section 11, improves a sealing performance, and prevents water and the like from entering the crimping section 11.

When forming the sealing member 23 from a conductive material, the conductive material may be solder, a low-melting-point metal chip, or the like. When solder is used as the sealing member 23, the crimping section 11 is crimped around the covered electric wire 5 and the solder is arranged to cover and seal the conductor 7 at a tip of the conductor crimping part 13. The solder is then hardened. The solder serving as the sealing member 23 prevents the conductor 7 from being exposed to the outside, closely attaches to a front end face of the conductor crimping part 13, and seals the inside of the crimping section 11.

When using the low-melting-point metal chip as the sealing member 23, the low-melting-point metal chip is arranged to cover the conductor 7 of the covered electric wire 5 before crimping the crimping section 11 around the covered electric wire 5. In this state, the covered electric wire 5 is arranged in the crimping section 11 and the crimping section 11 is crimped with a jig while applying a predetermined pressure or heat thereto, thereby covering the low-melting-point metal chip with a front end of the conductor crimping part 13. The low-melting-point metal chip serving as the sealing member 23 melts at a relatively low temperature, closely attaches to front end faces of the conductor 7 and conductor crimping part 13, and seals the inside of the crimping section 11.

In this way, the sealing member 23 of the conductive material prevents water and the like from penetrating into the crimping section 11 and increases a contact area between the conductor 7 of the covered electric wire 5 and the crimping section 11.

According to the electric connection terminal 1 mentioned above, the crimping section 11 is tightly attached to and crimped around the conductor 7 to the cover 9 of the covered electric wire 5, thereby preventing the formation of a gap that may allow water and the like to penetrate between the crimping section 11 and the covered electric wire 5.

A compression ratio of the boundary crimping part 19 in the state of crimped around the covered electric wire 5 is set to be higher than that of the cover crimping part 15. Even if water and the like enters from the cover crimping part 15, the boundary crimping part 19 prevents penetration of the water and the like, thereby preventing the conductor 7 from being corroded with the water and the like.

In this way, the electric connection terminal 1 mentioned above is capable of preventing the formation of a water penetrative gap between the crimping section 11 and the covered electric wire 5, thereby improving water resistivity and suppressing corrosion of the conductor 7 of the covered electric wire 5.

In the crimping section 11, the longitudinal length Li of the part to be crimped around the cover 9 of the covered electric wire 5 is set to be longer than the length Lc of the conductor crimping part 13. Even if water enters from an end of the cover crimping part 15 into the crimping section 11, the water hardly reaches the conductor 7 because of the long distance up to the conductor 7, thereby preventing the water and the like from wetting the conductor 7.

At an end of the cover crimping part 15, the crimping section 11 is provided with the taper 21 to form a downward slope toward the conductor 7. The taper 21 prevents the end of the cover crimping part 15 from damaging the cover 9 when the crimping section 11 is crimped around the covered electric wire 5, thereby protecting the covered electric wire 5.

In the crimping section 11, an end of the conductor crimping part 13 is provided with the sealing member 23 to prevent water and the like from entering into the conductor 7 from the end of the conductor crimping part 13, thereby preventing corrosion of the conductor 7.

In the case that the sealing member 23 is arranged at an end of the conductor crimping part 13 of the crimping section 11 when the crimping section 11 is crimped around the covered electric wire 5, the number of processes can be reduced because crimping the crimping section 11 and arranging the sealing member 23 are simultaneously carried out.

If the sealing member 23 is an insulating material, a high water resistant material such as synthetic resin may be used to prevent water and the like from penetrating the crimping section 11 and further improve water resistivity.

If the sealing member 23 is of an insulating material, ultraviolet curable resin may be chosen. In this case, the ultraviolet curable resin is arranged to cover the conductor 7 before applying ultraviolet rays and ultraviolet rays are applied to the ultraviolet curable resin to harden the ultraviolet curable resin and seal an end of the conductor crimping part 13 of the crimping section 11. Even if the end of the conductor crimping part 13 of the crimping section 11 has a complicated shape, the inside of the crimping section 11 can be sealed.

If the sealing member 23 is made of a conductive material, the conductive material will increase a contact area between the conductor 7 of the covered electric wire 5 and the conductor crimping part 13 and improve conductivity between the covered electric wire 5 and the electric connection terminal 1.

If the sealing member 23 is made of a conductive material and if the conductive material is low-melting-point metal, heat of relatively low temperature is applied to the crimping section 11 or pressure is applied when crimping the crimping section 11, so that the low-melting-point metal melts to cover the conductor 7. This increases a contact area between the conductor 7 and the conductor crimping part 13 and seals an end of the conductor crimping part 13.

Although the electric connection terminal according to the embodiment of the present invention is the female terminal having the cylindrical contact section, it may be a male terminal having a tab serving as a contact section.

The material and shape of the sealing member are properly selected according to environments and are not limited to those mentioned above.

The present invention has an effect of providing the electric connection terminal that prevents the formation of a gap between the crimping section and a covered electric wire and improves water resistivity.

The invention claimed is:

1. An electrical connection terminal comprising:

a contact section for electrical connection with a mating terminal; and a crimping section provided integral with the contact section, for being crimped onto, so as to cover over, a coated electrical cable from a conductor portion to a coating portion thereof, and be electrically connected and fixed to the coated electrical cable, the crimping section including:

a conductor-crimping portion for being tight-contact crimped to the conductor portion of the coated electrical cable, a coating-crimping portion for being tight-contact crimped to the coating portion of the coated electrical cable; and a boundary-crimping portion for being tight-contact crimped to the coated electrical cable at and along a boundary where the coating portion meets the conductor portion of the coated electrical cable; wherein the boundary-crimping portion is established to have a higher compressibility than the compressibility of the coating-crimping portion, in a state in which the electrical connection terminal is crimped around a coated electrical cable.

2. The electrical connection terminal of claim 1, wherein the crimping section is formed with its longitudinal length where it crimps the coating portion of a coated electrical cable being longer than the length of the crimping section's conductor-crimping portion.

3. The electrical connection terminal of claim 1, wherein the coating-crimping portion of the crimping section ends in an inward-tapering rim sloping toward the conductor portion of a coated electrical wire with the electrical connection terminal having been crimped thereon.

4. The electrical connection terminal of claim 1, wherein the conductor-crimping portion of the crimping section ends in a sealing member provided for interiorly sealing the crimping section.

* * * * *